United States Patent [19]

Steenbergen et al.

[11] Patent Number: 4,720,212

[45] Date of Patent: Jan. 19, 1988

[54] METHOD AND APPLIANCE FOR LAYING A SHEET OF MATERIAL IN THE GROUND

[75] Inventors: Bastiaan G. Steenbergen, Essen, Belgium; Arie A. Hofman, Renkum, Netherlands

[73] Assignee: Digging Trading Company N.V., Klaaswaal, Netherlands

[21] Appl. No.: 828,998

[22] Filed: Feb. 13, 1986

[30] Foreign Application Priority Data

Feb. 14, 1985 [NL] Netherlands ..... 8500421

[51] Int. Cl.[4] ..... E02F 5/10; F16L 1/02; E02B 11/00; E02D 31/02

[52] U.S. Cl. ..... 405/176; 405/38; 405/50; 405/270

[58] Field of Search ..... 405/36, 38, 50, 52, 405/156, 157, 174, 176, 177, 179, 180, 183, 267, 270, 107, 109; 47/9, 56; 111/1, 2, 3, 7

[56] References Cited

U.S. PATENT DOCUMENTS

| | | | |
|---|---|---|---|
| 3,282,057 | 11/1966 | Prosser | 405/157 |
| 3,327,484 | 7/1967 | Launder et al. | 405/157 |
| 3,339,369 | 9/1967 | Ryan | 405/157 |
| 3,590,588 | 7/1971 | Draper et al. | 405/176 |
| 3,603,097 | 9/1971 | Zakiewicz | 405/50 |
| 4,379,655 | 4/1983 | Brost et al. | 405/176 |
| 4,597,693 | 7/1986 | McQuary et al. | 405/50 X |

FOREIGN PATENT DOCUMENTS

| | | | |
|---|---|---|---|
| 33617 | 2/1983 | Japan | 405/38 |
| 13104 | 1/1985 | Japan | 405/270 |
| 308159 | 9/1971 | U.S.S.R. | 405/157 |
| 685749 | 9/1979 | U.S.S.R. | 405/270 |

*Primary Examiner*—Nancy J. Stodola

*Attorney, Agent, or Firm*—Dennison, Meserole, Pollack & Scheiner

[57] ABSTRACT

A sheet of material is laid in the ground by digging a trench in the ground by means of a trench digger and unwinding the sheet of material from a stock roll above ground level, passing it into the trench in a downward direction and diverting it in a direction essentially parallel to ground level. In order for the protective housing which is attached downstream of the trench digger and has to keep the trench open over its length not to be designed too long the sheet of material is passed into the trench folded double and is unfolded via three return rollers or rods or flanges, and passed in the unfolded state in an approximately vertical plane in the horizontal direction. To lay the film at a particular depth in an approximately horizontal position or in the shape of an essentially horizontal gutter in the ground the sheet of material is passed, folded double, in a trench in the shape of an inverted T and, via four return rollers or rods or plate edge flanges which are located essentially near the bottom of the trench, is folded open and passed further in a horizontal or gutter-shaped position in the horizontal direction.

4 Claims, 8 Drawing Figures

12
11
13

METHOD AND APPLIANCE FOR LAYING A SHEET OF MATERIAL IN THE GROUND

The invention relates in the first place to a method for laying a sheet of material in the ground, wherein a trench is dug in the ground and the sheet is passed into the trench while being unwound from a stock roll, the sheet of material being fed, with its linear dimension in a downward direction, into the trench from the stock roll located above ground level, and the linear dimension of the sheet being diverted in a direction which is essentially parallel to ground level via at least one return roller or rod or flange.

A method of this type is known from DE-A-3,012,980.

Sheets of material laid in the ground can consist of a filter mat, a plastic film, a protective bituminous layer and the like. As can be seen in the abovementioned German patent application filter mats are employed for improving the drainage of a plot of land, in particular a sports field. A protective layer of plastic or bitumen in the ground can be used to prevent or limit spreading of impurities as a result of a horizontal flow of ground water in order to maintain a difference in water level inside and outside the protective layer—in the case of sinking a well hold back to musk-rats and to prevent a dike section from being disturbed because of drying up as a consequence of seepage into the underground. Whereas laying a filter mat in the ground is described in the above-mentioned German patent application, the laying of a plastic film in the ground is known per se from Dutch Patent Application No. 69,00976.

By laying a protective plastic layer in the ground in the manner indicated at the outset the transition between two successive, mutually overlapping parts of the sheet of material can be made watertight in a reliable manner above ground level. The joints between successive sheets of film can for example be made on an adhesive board above ground level, the entire length of film being laid uninterruptedly in the trench from a stock roll by diverting the slanting or vertical film in the horizontal direction.

A drawback of the known method occurs if the film is relatively wide which is necessary in the case of a relatively large height of the dug trench. In that case the protective housing, which is necessary to keep the trench walls from collapsing, has to be relatively long.

In a first embodiment of the method according to the invention this drawback is obviated and the length of the protective housing can be reduced by half because the sheet of material is passed, folded double, into the trench and is unfolded and passed further, via three return rollers or rods or flanges, in the unfolded state in an approximately vertical plane in the horizontal direction.

It may be necessary for certain applications to lay the film in the ground at a particular depth in an approximately horizontal position or in the form of an essentially horizontally extending gutter.

Starting from the method mentioned in the introduction this can be achieved without major difficulties if the sheet of material is passed, folded double, into a trench in the form of an inverted T and, via four return rollers or rods or flanges which are located near the bottom of the trench, is folded open or unfolded and is guided further in a horizontal or gutter-shaped position in the horizontal direction.

An apparatus for carrying out the first-mentioned embodiment of the method according to the invention comprises a trench digger for digging a trench, a protective housing for protecting the trench against collapsing of the trench walls, means which are located above the protective housing for mounting a sheet of material and three return rollers or rods or flanges which are arranged on top of each other in the protective housing and which are attached to the protective housing and of which two converge in the direction of the trench digger, while the third one, starting from a point near the point of convergence of the first two, extends essentially along the longitudinal direction of the protective housing.

The second embodiment of the method according to the invention can be carried out using an apparatus which is provided with a trench digger for digging a trench, a protective housing for protecting the trench against collapsing of the trench walls, means which are located above the protective housing for mounting the sheet of material, four return rollers or rods or flanges located essentially next to each other being fixed in the protective housing near the bottom of the latter, two of which return rollers or rods or flanges converge in the direction of the trench digger and the other two essentially extend, starting from points near the point of convergence of the first two, in the longitudinal direction of the housing. The latter two rollers or rods or flanges preferably include an angle of about 45° with the first two.

The trench in the form of an inverted T can be made when the digging beam is provided at its lower end with laterally projecting digging screws. In this case the protective housing will have to possess a cross-section in the form of an inverted T.

The invention will now be explained in more detail with reference to the figures in which some exemplary embodiments are shown.

Figure 6:
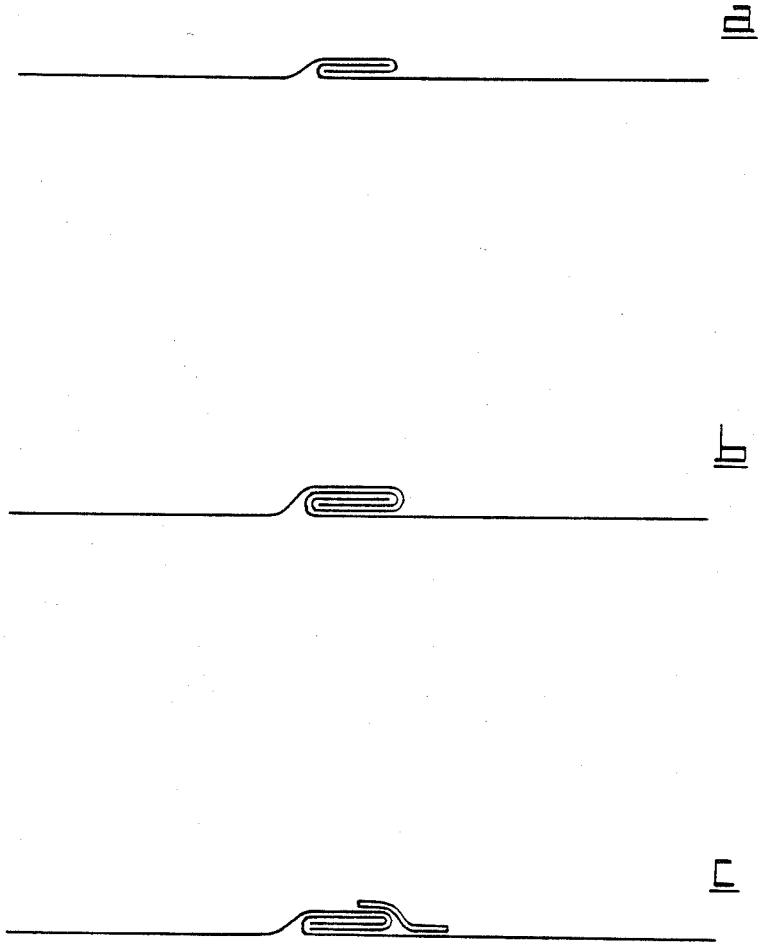

FIGS. 6*a*, *b* and *c* show three different manners in which successive films can be attached to one another at the overlap.

Figure 1:
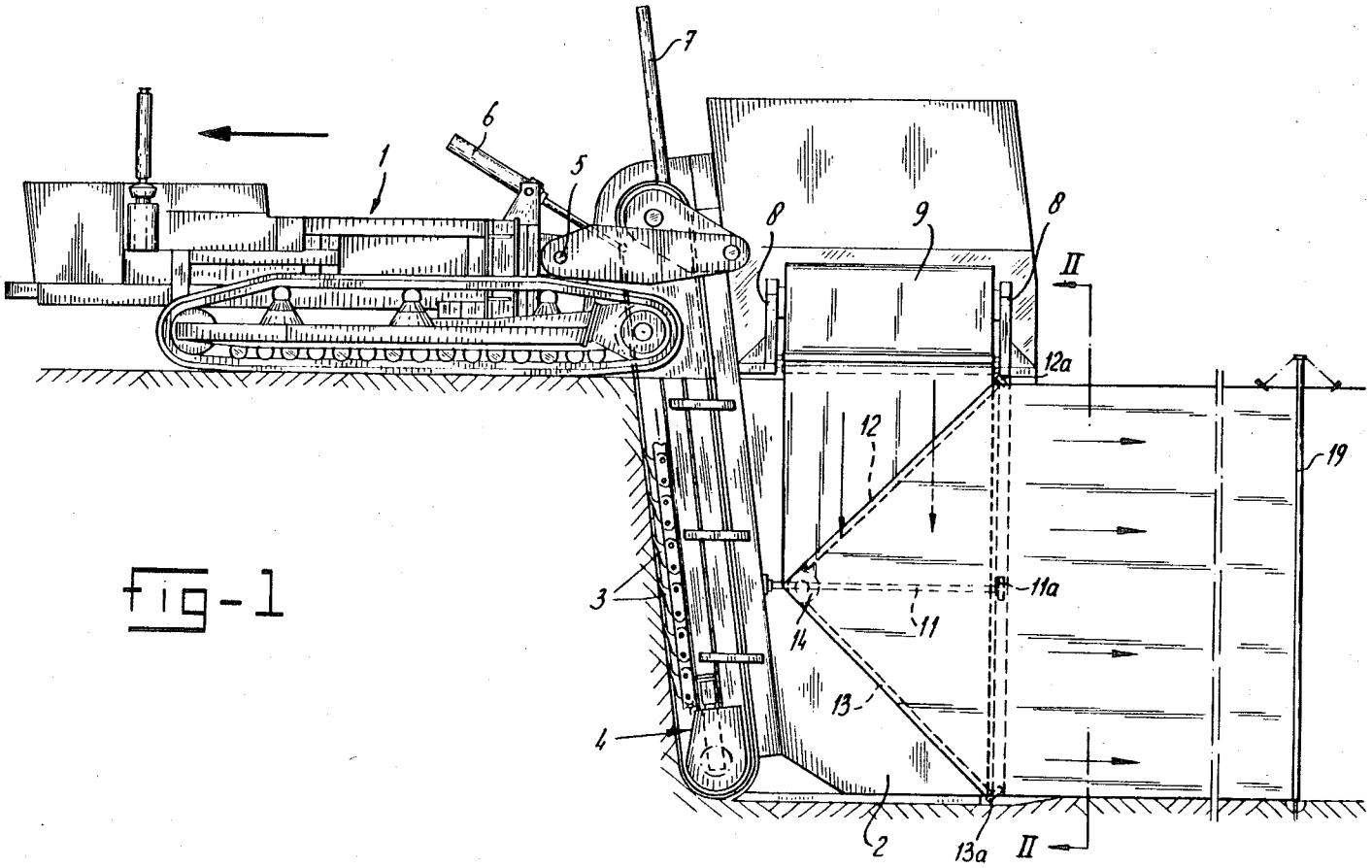
FIG. 1 shows a side view of an apparatus for laying, according to the invention, a protective layer in the ground, the ground dug and the protective housing being assumed to be cut through in the longitudinal direction.

The apparatus according to FIGS. 1 and 2 comprises a trench digger 1, known per se, for digging a trench in the ground, a protective housing 2 for keeping the dug trench open over a particular distance and means, to be described in more detail later, for passing a film into the trench.

The digging beam 4, of the trench digger, which is provided with a digging chain 3 has a hinge point at 5 and can be tilted through a particular angle by means of two hydraulic cylinders 6. Two hydraulic cylinders 7 are present in order to be able to adjust the depth of the digging beam.

The means for passing the film into the protective housing and, via the protective housing, into the dug trench comprise bearings 8 for rotatably supporting a film roll 9 and three return rollers located in the protective housing and attached thereto, namely a horizontal roller 11 and two rollers 12, 13 which extend at an angle of approximately 45° with the horizontal. The rollers 12, 13 converge towards a solid slider 14, the roller 12 extending towards ground level and the roller 43 extending towards the bottom of the protective housing. The roller 11 extends from a point near the slider 14. The film as supplied on the roll 9 is folded double along the length thereof. This has the purpose of limiting the length of the protective housing. The fastening points of rollers 11, 12, 13 ae indicated by 11*a*, 12*a* and 13*a* respectively.

Figure 3:
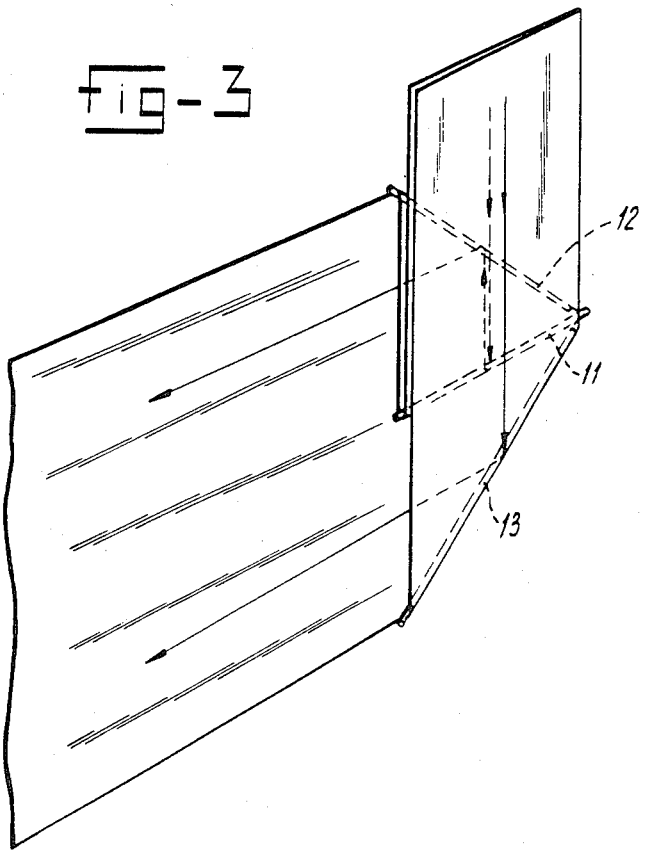
FIG. 3 shows a perspective view of the manner in which, in the apparatus according to FIGS. 1 and 2, the doubly folded film is fed into the trench, folded open and further passed in a vertical position in the horizontal direction.

FIG. 3 shows the manner in which the film is passed in a vertical direction in the protective housing and is folded open or unfolded by means of rollers 11, 12, 13 and is diverted in a horizontal direction. The height of the single film passed in a horizontal direction is twice the width of the folded film which is introduced in a vertical direction.

Figure 2:
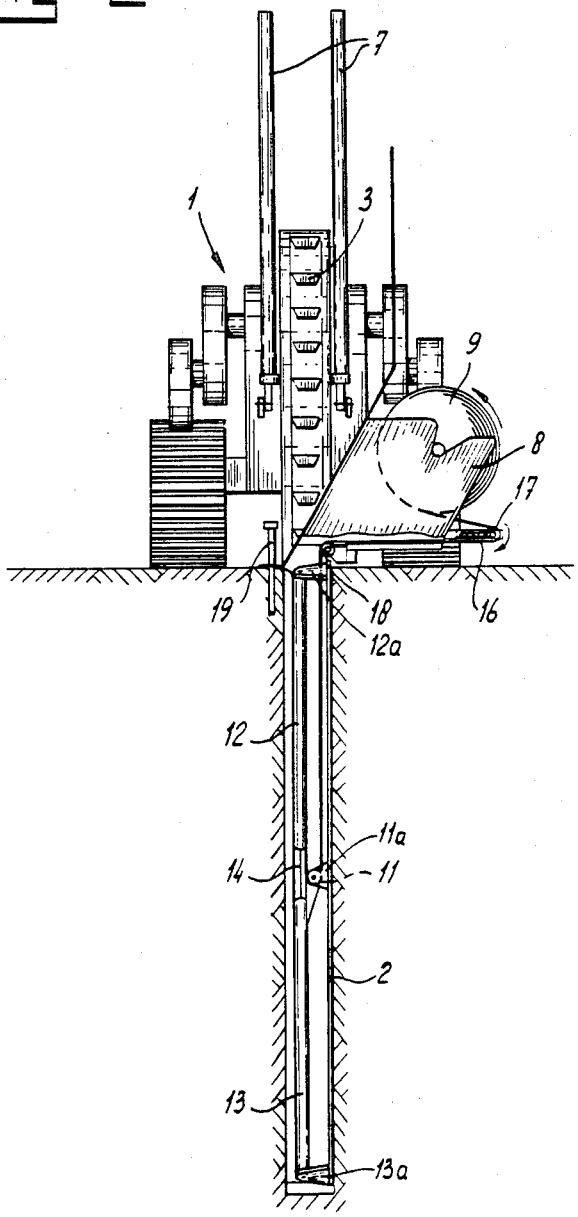
FIG. 2 shows a cross-section along line II—II in FIG. 1.

As is evident in particular from FIG. 2, an adhesive board 16 is located above ground level, over which board the film is passed by means of a spring-loaded tension roller 17 and a guide roller 18. Successive films, the edges of which overlap, can be attached to one another on this board. FIGS. 6*a, b* and *c* show various possibilities to fold the edges, to which adhesive has been applied, into each other. FIG. 6*c* shows how the joint obtained can be additionally reinforced with adhesive tape.

It is of importance that the film passed into the trench is held firmly and for this purpose use can be made, for example, of pawls 19 which penetrate the folded-over upper edge of the film.

Figure 4:
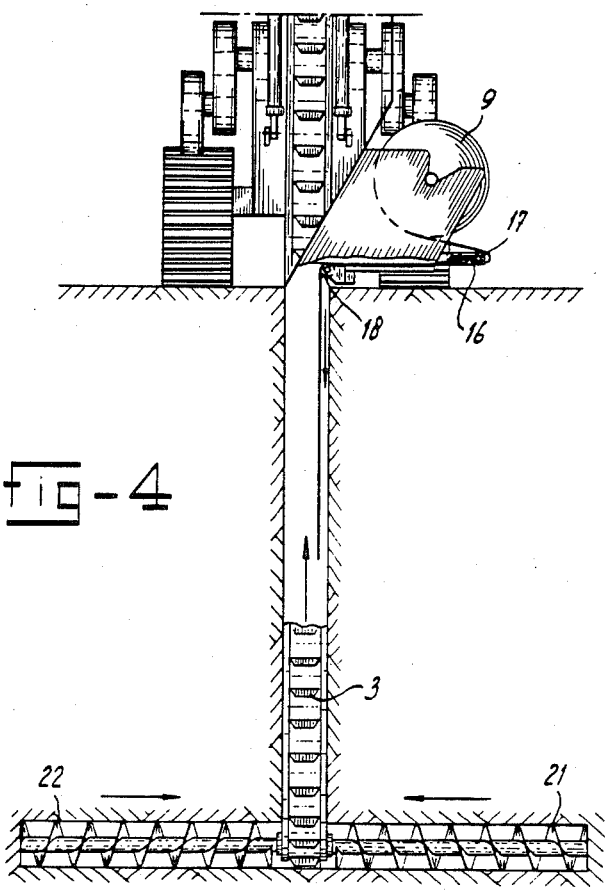
FIG. 4 shows a cross-section of a second embodiment of the appliance according to the invention in which the film is brought into a horizontal position at a particular depth.
Figure 5:
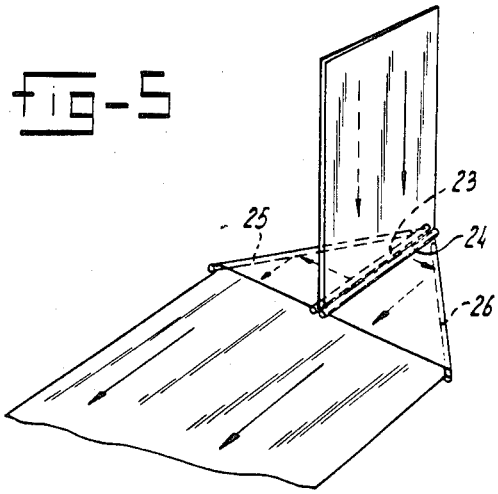
FIG. 5 shows a perspective view of the manner in which, using the apparatus according to FIG. 4, the doubly folded film is folded open.

FIG. 4 shows a second embodiment of the apparatus according to the invention, in which two screws 21, 22 are attached to the bottom of the digging beam and are driven by the lowermost deflection wheel of the digging chain and can ensure, together with the digging chain, the formation of a trench in the form of an inverted T. The protective housing, not shown, will also have the form of an inverted T. FIG. 5 shows the manner in which the doubly-folded, vertically supplied film is folded open by means of the four rollers 23, 24, 25 and 26 which are located approximately in a horizontal plane, and is passed further in the horizontal direction over the horizontal bottom of the trench. These rollers 23 up to and including 26, too, are fixed in the protective housing which is fixed to the digging beam directly downstream of the latter. The rollers 23 and 24 can be displaced downwards relative to rollers 25 and 26 to such a degree that the film assumes the shape of a gutter. It is possible to fill this gutter with a particular material (clay, gravel, motar, asphalt).

Within the scope of the invention various modifications are possible. The film need not always be watertight. In the case of preventing seepage into the ground of a dike section the upper part of the film can be water-permeable. A sheet of material consisting of a different material can be used in place of a film, for example consisting of asphalt or of drainage material. The method and apparatus according to the invention are, however, particularly suitable for laying a film in the ground. The trench can be placed under a small angle (5° to 10°); the protective layer wil then come to rest on a trench wall and will not be readily pulled downwards by soil falling into the trench. The stock roll does not always have to run parallel to the trench. Naturally, in place of rollers 11, 12, 13; 23, 24, 25 and 26 rods or flanges of plates can also be used. For example, the deflection members 25 and 26 in FIG. 5 could consist of two flanges defined by two edges of a plate with a triangular part which is pushed into the film.

What is claimed is:

1. Method for laying a sheet of material in the ground, wherein a trench is dug in the ground and the sheet is passed into the trench while being unwound from a stock roll, the sheet of material being fed, with its longitudinal dimension in a downward direction, into the trench from the stock roll located above ground level, and deflection means for turning the longitudinal dimension of the sheet, within the trench, to extend longitudinally in said trench; the method comprising the steps of introducing the sheet of material into the trench folded on itself along its length, unfolding said sheet into an approximately vertical plane, and extending said sheet along the trench.

2. Apparatus for use in conjunction with a trench digger for the laying of sheet material in a dug trench, a protective housing receivable within and movable along a dug trench for protecting the trench against collapsing of walls of the trench, means located above the protective housing for mounting a longitudinally folded sheet of material for longitudinal introduction of the folded sheet downward into said housing, three elongate sheet unfolding members arranged in a substantially vertical plane within the housing for engagement of the downwardly introduced folded sheet therewith for the unfolding of the sheet into a substantially vertical plane and the directing of the unfolded sheet longitudinally along the trench, two of said sheet unfolding members converging toward a point of convergence in the direction of movement of the protective housing, the third sheet unfolding member, starting from a point near the point of convergence of the first two members, extending between the converging members rearwardly relative to the direction of movement of the housing and essentially parallel to the trench.

3. Apparatus for use in conjunction with a trench digger for the laying of a sheet of material in a dug trench, a protective housing receivable within and movable along a dug trench for protecting the trench against collapsing of walls of the trench, means located above the protective housing for mounting a longitudinally folded sheet of material for longitudinal introduction of the folded sheet downward into said housing, four elongate sheet unfolding members located in generally horizontal spaced relation to each other within the trench for engagement of the downwardly introduced folded sheet therewith, two of said sheet unfolding members converging toward a point of convergence in the direction of movement of the protective housing, the other two sheet unfolding members, starting from points near the point of convergence of the first two members, extending between the converging members rearward relative to the direction of movement of the housing and generally parallel to the trench, said other two sheet unfolding members paralleling each other in closely spaced relation for reception of the folded sheet downward therebetween and laterally thereabout for a generally horizontal unfolding of the sheet toward the first two members and a redirecting of the generally horizontal unfolded sheet, by the first two members, longitudinally along the trench.

4. Apparatus for use in conjunction with a trench digger for the laying of a sheet of material in a dug trench, a protective housing receivable within and movable along a dug trench for protecting the trench against collapsing of walls of the trench, means located above the protective housing for mounting a longitudinally folded sheet of material for longitudinal introduction of the folded sheet downward into said housing, multiple elongate sheet unfolding members within the trench for engagement of the downwardly introduced folded sheet therewith, two of said sheet unfolding members converging toward a point of convergence in the direction of movement of the protective housing, said two converging members defining a plane, the remainder of said sheet unfolding members lying substantially in said plane and, starting from generally the point of convergence of the first two members, extending between the converging members rearward relative to the direction of movement of the housing and generally parallel to the trench for reception of at least a portion of the folded sheet thereabout and a redirecting of the sheet toward at least one of the first two members for a subsequent redirecting longitudinally along the trench.

* * * * *